US007165347B2

(12) United States Patent
Ollinger, IV et al.

(10) Patent No.: US 7,165,347 B2
(45) Date of Patent: Jan. 23, 2007

(54) ASSEMBLY FOR SECURING A WEAR MEMBER TO AN EXCAVATOR

(75) Inventors: Charles G. Ollinger, IV, Aloha, OR (US); Noah D. Cowgill, Portland, OR (US)

(73) Assignee: Esco Corporation, Portland, OR (US)

( * ) Notice: Subject to any disclaimer, the term of this patent is extended or adjusted under 35 U.S.C. 154(b) by 0 days.

(21) Appl. No.: 10/290,472

(22) Filed: Nov. 8, 2002

(65) Prior Publication Data

US 2003/0121185 A1 Jul. 3, 2003

Related U.S. Application Data

(63) Continuation-in-part of application No. 09/986,705, filed on Nov. 9, 2001, now Pat. No. 6,729,052.

(51) Int. Cl.
*E02F 9/28* (2006.01)

(52) U.S. Cl. ..... 37/452; 37/457; 403/374.4

(58) Field of Classification Search ..... 37/452, 37/453, 454, 455, 456, 457, 449, 450; 403/350, 403/374.3, 374.4, 372; 172/753, 772
See application file for complete search history.

(56) References Cited

U.S. PATENT DOCUMENTS 2,772,492 A 12/1956 Murtaugh
3,879,867 A 4/1975 Ericson et al.
3,919,792 A * 11/1975 Hahn et al. ..... 37/455
4,414,764 A * 11/1983 Johansson et al. ..... 37/450
4,470,210 A 9/1984 Hahn
4,481,728 A 11/1984 Mulder et al.
4,748,754 A 6/1988 Schwappach
4,891,893 A 1/1990 Bowes, Jr.
5,088,214 A 2/1992 Jones
5,177,886 A * 1/1993 Klett ..... 37/452
5,233,770 A 8/1993 Robinson
5,311,681 A 5/1994 Ruvang et al.
5,325,615 A 7/1994 Hutchins et al.
5,394,629 A 3/1995 Ruvang et al.
5,438,774 A 8/1995 Fletcher et al.
5,526,593 A 6/1996 Coppage
5,564,206 A 10/1996 Ruvang
5,653,048 A 8/1997 Jones et al.
5,806,215 A 9/1998 Matthews
5,806,216 A 9/1998 Renski
5,909,962 A 6/1999 Livesay et al.
5,983,534 A 11/1999 Robinson et al.
6,030,143 A 2/2000 Kreitzberg
6,047,487 A 4/2000 Clendenning
6,079,132 A 6/2000 Clendenning
6,108,950 A 8/2000 Ruvang et al.
6,578,294 B2 6/2003 Ollinger, IV
6,729,052 B2 * 5/2004 Ollinger et al. ..... 37/452

* cited by examiner

*Primary Examiner*—Victor Batson
(74) *Attorney, Agent, or Firm*—Steven P. Schad

(57) ABSTRACT

An assembly for mounting an excavating tooth particularly suited for a dredge cutterhead includes a base, an adapter, and a lock. The base includes a convex, curved bearing surface that abuts a concave, curved bearing surface on the adapter. The curved bearing surfaces are able to maintain substantially full contact with each other under transverse loading.

82 Claims, 13 Drawing Sheets

ASSEMBLY FOR SECURING A WEAR MEMBER TO AN EXCAVATOR

This application is a continuation-in-part of application Ser. No. 09/986,705, filed Nov. 9, 2001, now U.S. Pat. No. 6,729,052 B2, issued on May 4, 2004.

FIELD OF THE INVENTION

The present invention pertains to an assembly for securing a wear member to excavating equipment, and in particular, for attaching an adapter to a dredge cutterhead.

BACKGROUND AND SUMMARY OF THE INVENTION

Dredge cutterheads are used for excavating earthen material that is underwater, such as a riverbed. One example of a dredge cutterhead is illustrated in FIG. 17. In general, a dredge cutterhead include several arms 11 that extend forward from a base ring 16 to a hub 23. The arms are equally spaced about the base ring and formed with a broad spiral about the central axis of the cutterhead. Each arm is provided with a series of spaced apart teeth 12 to dig into the ground.

In use, the cutterhead is rotated about its central axis to excavate the earthen material. To excavate the desired swath of ground the cutterhead is moved side-to-side as well as forward. On account of swells and other movement of the water, the cutterhead will also tend to move up and down, and periodically impact the bottom surface. As a result of this unique cutting action, the teeth of a dredge cutterhead experience heavy transverse as well as axial loading and heavy impact jacking loads that thrust the tooth up, down and sideways. The heavy transverse loading of the tooth is further engendered by the operator's inability to see the ground that is being excavated underneath the water. Unlike other excavators (e.g., a front end loader), the operator of a dredge cutterhead cannot effectively guide the cutterhead along a path to best suit the terrain to be excavated.

Due to the rotative digging action of the cutterhead, each tooth penetrates the ground on the order of 30 times a minute as compared to about 1 time a minute for mining teeth. As a result, the teeth experience a great amount of wear during use. It is desirable therefore for the teeth to be easily removed and installed to minimize downtime for the cutterhead. As is common with wear assemblies for excavating equipment, dredge teeth comprise a plurality of integrally connected parts so as to minimize the amount of material needing replacement, i.e., only the worn components need to be replaced.

In the example of FIG. 17, each tooth includes a base 18, an adapter 13, a point or tip 17, and a lock 29. The base 18 is cast on the arm 11 at a particular location and orientation to maximize digging. Adapter 13 includes a rear end 22 that is received in a socket 14 defined in the base, and a forwardly projecting nose 15 to hold the point 17. A removable lock 29 is provided to facilitate the required frequent replacement of the tooth points 17. The adapter is held in the socket by a large fillet weld about the circumference of the rear end 22. In other known dredge cutterheads 1, the adapter 2 is bifurcated to define a pair of legs that are configured to wrap about the arm 3 (FIG. 18). These adapters are welded directly to the arm without a base member.

Although the tooth points require the most frequent replacement in a dredge cutterhead, the adapters still wear and need periodic replacement. However, replacing even a single adapter on a dredge cutterhead is a long process. The welded adapter must first be cut off with a torch. Then, portions of the arm and base that were damaged by the removal of the adapter must be repaired and rebuilt. Finally, a new adapter is welded into place. This process typically entails 10–12 man-hours per adapter. Hence, a lengthy delay in a dredging operation is unavoidable even when replacing only a single adapter. Moreover, in view of this lengthy delay, an operator will often wait until several adapters need replacement to take the cutterhead out of operation. As a result, the actual delay in operation that usually results is longer. Indeed, with a typical cutterhead having 50–60 teeth a rebuilding process of the entire cutterhead could require more than 600 man-hours. In an effort to avoid substantial loss of dredging time, most dredging operations maintain three or four cutterheads so that the entire cutterhead can be exchanged when one or more adapter needs to be replaced, the cutterhead needs to be rebuilt, or if the cutterhead breaks. However, a cutterhead is expensive. The maintaining of extra cutterheads that are not used, but held only when the one in use is serviced is an undesirable use of resources.

In one aspect of the present invention, the adapter is mechanically attached to the arm for easy installation and removal. The adapter is held to a base on the arm solely by a mechanical construction without the need for welding the adapter. In the preferred construction, the base and adapter are formed with complementary coupling configurations to prevent release of the adapter from the base except in a release direction. A removable lock is used to prevent undesired release of the adapter from the base in the release direction. With a mechanical attachment, the adapter can be easily replaced by simply removing the lock and moving the adapter in the release direction. There is no weld to be cut, no need to repair the base and arm, and no re-application of a weld. As opposed to 10–12 man-hours for replacing a welded adapter, a mechanically attached adapter in accordance with the present invention can be changed in as little as 10 minutes. This is a dramatic improvement which not only substantially reduces downtime for the cutterhead, but can also make the elimination of an entire spare cutterhead at the dredging site possible. As a result, instead of typically needing three or four cutterheads at a dredge site, only two or three may be needed.

In a preferred construction of the present invention, the adapter includes a generally T-shaped slot that receives a complementarily-shaped tongue on the base, and an opening for receiving a lock. The lock, when inserted into the opening, opposes a wall of the base and a wall of the opening to prevent release of the tongue and slot, and thereby holds the adapter to the base.

It is common for adapters of various excavators, such as a front end loader, to be mechanically attached to the excavating bucket. For example, U.S. Pat. No. 5,653,048 discloses an adapter with a T-shaped slot that receives a T-shaped boss welded to the lip of an excavating bucket. A lock is fit within an opening in the top of the adapter to prevent loss of the adapter from the lip. A bearing surface is formed at the front end of the boss to provide axial support for the adapter. While this construction well supports an adapter on an excavating bucket, it is not well suited for use on a dredge cutterhead.

In an excavating bucket, the teeth are primarily subjected to axial loading as the bucket is driven forward through the ground. However, as discussed above, the teeth on a dredge cutterhead are subjected to heavy and frequent transverse loads due to the manner in which the cutterhead is operated.

In the noted '048 patent, the adapter 4 is slid onto the boss 5 with a slight side clearance for ease of assembly. The application of a large side load L applied against the tooth point 6 tends to rotate the adapter about the received boss to the extent of the defined clearance between the parts (FIG. 16). This rotation of the adapter results in the generation of resistant forces R1–R4 and high stresses being generated through essentially "point" contacts in the corners of the assembly. Although true point contact is impossible, the term is used to identify large applications of force over a relatively small area. In particular, the application of large forces R2, R3 at "points" on the front of the base and the lock 7 place exceptionally high levels of stress on the components. Such high stress levels, in turn, cause greater wearing of the parts at these locations and a shortened usable life of the parts. The increased wearing also enlarges the clearance space, which can lead to rattling of the components during use. Such rattling of the parts further quickens wearing of the parts.

In ordinary digging, such as with a front end loader, fines become impacted between the adapter and base so that rattling is reduced or eliminated even when wearing has created large gaps between the parts. However, in a dredging operation, the water sweeps the fines in and out of the gaps, and prevents the build up of fines between the parts. Since the gaps between the parts would ordinarily remain in a dredging operation, an adapter mechanically attached to a boss on a dredge cutterhead by a known construction would continually rattle against the boss and repeatedly apply large loads in point contacts along the front and rear of the adapter. Moreover, since the fines are constantly swept into and out of the gaps between the parts with the water, the fines would actually function as a grinding compound on the parts to further exacerbate wearing of the parts. Consequently, adapters for dredging operations have not before been mechanically attached to the dredge cutterhead arms.

However, these shortcomings are overcome in the present invention so that adapters in dredging teeth can be mechanically attached to the arms. In particular, the front of the base is curved and in contact with a complementary abutment of the adapter. As a result, when side loads push the adapter in a rotative manner, the arcuate shape of the bearing surfaces enables the surfaces to remain in substantially full flush contact with each other. This full contact arrangement as opposed to a point contact greatly reduces the stress otherwise experienced in the corners of the components. Rather than having high loads applied essentially as point contacts, the loads are spread over substantially the entire bearing surface to greatly minimize the stress in the parts and, in turn, substantially lengthen the usable life of the parts.

In a preferred construction, the arcuate bearing surfaces define spherical segments to maintain substantially full contact between the bearing surfaces of the adapter and the base under both horizontal and vertical transverse loading. In addition, the rear bearing surface of the base and the front of the lock are also preferably formed with similar arcuate surfaces to likewise maintain substantially full contact between the lock and the base. Preferably, the radii of curvature for the bearing surface at the front and rear of the adapter originate from the same point.

In another aspect of the invention, a wear member for use with excavators other than dredge cutterheads could also be benefited by incorporating the curved bearing surfaces described above for the adapter.

In another aspect of the present invention, the lock is formed to tighten the connection between the base and adapter. A tightened assembly alleviates rattling and thereby lengthens the useful life of the tooth. The above-noted '048, patent discloses a lock with a threaded plug that tightens the adapter on the boss. Nevertheless, the stress and strains of digging can work to loosen even an initially tightened arrangement such that the adapter will still shift and rattle against the base resulting in increased wear, particularly with the high frequency of penetration and varied loading of teeth on a dredge cutterhead. Further, with a loosening assembly, there would be nothing in a water environment to prevent the components from rattling during use.

Therefore, in accordance with another aspect of the present invention, the lock further includes a resilient element that cooperates with an actuator to maintain a tight engagement between the adapter and base even after loads have introduced wear between the parts. The resilient element is sandwiched between a pair of rigid members. The actuator initially pulls the adapter into a tight engagement with the base and draws the rigid members together to compress the resilient element. As looseness begins to develop in the assembly due to wearing, the resilient element expands to dampen any shifting or rattling of the adapter on the base and thereby maintain a tight engagement between the two components. The rigid members also preferably have at least one stop that prevents excessive compression of the resilient element. In this way, the rigid members initially form a rigid lock that is tightly set between the adapter and the base, and which also protect the internal resilient element from premature failure on account of being overloaded.

As discussed above, the arms in a dredge cutterhead have a broad spiraling configuration. As a result, the teeth each project from the arm at a unique orientation to maximize digging. Since the teeth are mounted in different orientations on the arm, care must be taken to ensure that each adapter is properly positioned on the arm. This additional positioning procedure further lengthens the time needed to install new adapters in past cutterheads. In the example illustrated in FIG. 17, a resin is poured into the socket to harden around the first mounted adapter to thus form a recess adapted to properly orient successive adapters for the dredging operation. Nevertheless, this design still requires a careful, time-consuming procedure to initially place the adapters properly on the arm as well as the extra work of pouring and curing the resin.

As can be appreciated, since there is no guiding base in the direct welding of adapters to the arms, such as in FIG. 18, it is nearly impossible to properly position each of the adapters for maximum digging efficiency. Moreover, arms on a dredge cutter do not have a uniform configuration as they extend from the base ring to the hub. To avoid the cost and trouble of having to make a specifically shaped adapter to custom fit each designated location along the arm, the adapters are formed to have a general fit on the arm. As a result, the fit is typically loose, thus making it even more difficult to properly position the adapter for welding. Digging efficiency is therefore usually lost in the improper mounting of such teeth to a dredge cutter.

In another aspect of the present invention, the arm is formed with a plurality of spaced apart locator formations along the front edge of the arm to properly position the teeth at the desired orientations. The locator formations each have the same structural configuration, although their orientations relative to the surrounding arm contour may differ so as to properly orient each tooth for the particular location along the arm. In one aspect of the invention, a separable base member is provided with a complementary coupling formation to matingly fit with the locator formations so as to support and position the adapter properly on the arm. As a result, each base can be formed with the same shape irrespective of where along the arm it is to be mounted. Moreover, these bases are adapted to be positioned on the dredge cutterhead in an easy, accurate and quick manner. In an alternative embodiment of the invention, a weld-on adapter includes a coupling formation to match the locator formations provided on the arm so that weld-on adapters can be easily secured in proper position on the arms. As with the bases of the invention, these adapters can each be made to have the same shape and easily positioned correctly irrespective of where along the arm they are to be mounted.

DETAILED DESCRIPTION OF THE PREFERRED EMBODIMENTS

The present invention pertains to an assembly for securing a wear member to an excavator. The present invention is particularly suited for mounting a tooth on a dredge cutterhead because of the ability of the tooth in the preferred construction to better withstand heavy transverse loading typical of a dredging operation and dampen rattling of the parts. Nevertheless, a tooth in accordance with the present invention could be used with other excavators. Additionally, other wear members used in excavating equipment (e.g., shrouds) could be mounted using the present invention.

Figure 1:
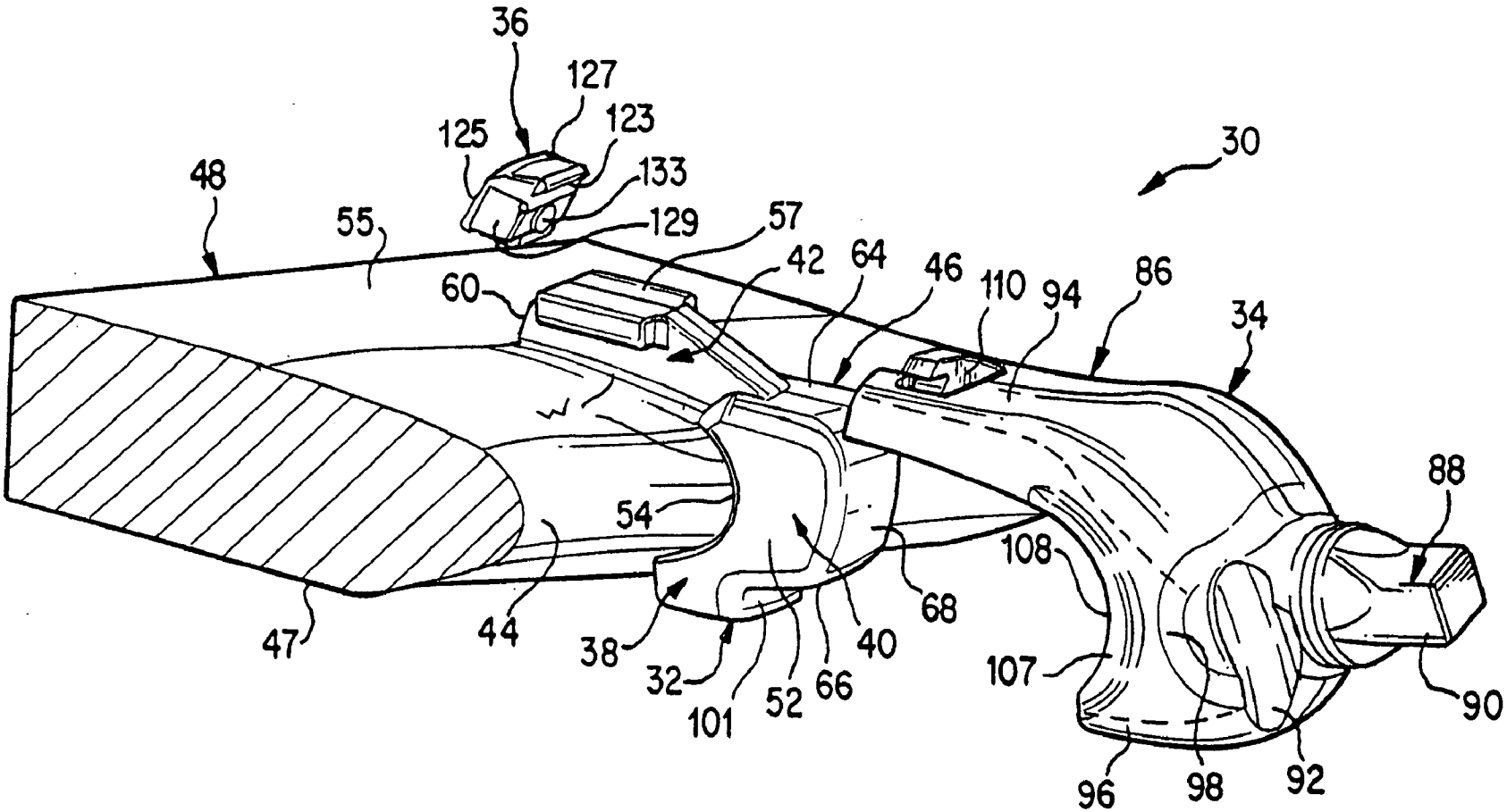
FIG. 1 is a front perspective exploded view of an attachment assembly in accordance with the present invention.

In accordance with the present invention, a tooth 30 includes a base or mount 32, an adapter 34, a point (not shown), and a lock 36 (FIG. 1). The tooth components will at times be described in relative terms, such as up and down, even though the operation of the dredging equipment will cause the teeth to assume many different orientations. These directions are used for explanation purposes only and should ordinarily be understood with respect to the orientation in FIG. 1.

In the preferred construction, base 32 has a lower leg 38, a front body 40 and an upper leg 42 in a generally U-shaped configuration (FIGS. 1–4) that wraps around the front edge 44 of an arm 48 of a cutterhead for enhanced support. The base is preferably a cast one-piece product that is fixed to the arm by welding W, but could be mechanically attached or constructed as a multi-piece component. Alternatively, the base could be fixed to the arm as a structure that is cast as a unitary part of the arm (not shown).

Lower leg 38 extends only a short distance along a lower side 47 of arm 48, although it may be omitted or provided with an extended construction. Upper leg 42 extends rearward along an upper side 55 of arm 48 and includes a coupling configuration 56 for securing the adapter. Since the lower or inner side 47 of an arm of a dredge cutterhead is more difficult to access, the coupling configuration is preferably formed to be on the upper or outer side 55 of the arm. Nevertheless, alternative constructions are possible. For instance, the legs could be reversed on the arm or a coupling configuration could be provided on both of the upper and lower sides of the arms. The legs 38, 42 and body 40 collectively define an inner surface 54 that faces the arm. To facilitate effective welding of the base to the arm, the inner surface 54 is shaped to substantially conform to the contour of the portion of arm 48 it opposes. The base is welded to the arm along substantially its entire perimeter to securely fix the base to the cutterhead.

Figure 2:
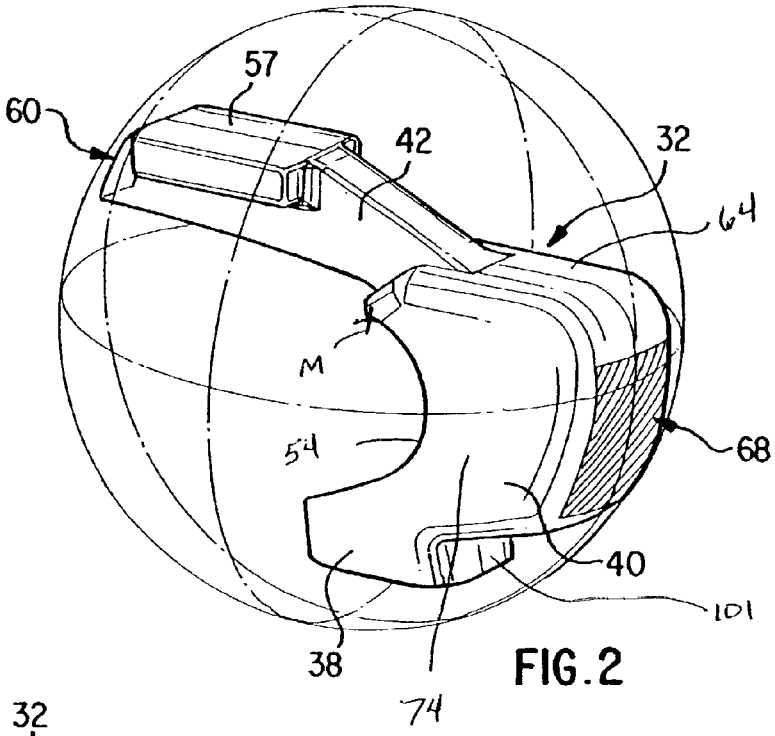
FIG. 2 is a perspective view of a base in accordance with the present invention in conjunction with an imaginary sphere.
Figure 3:
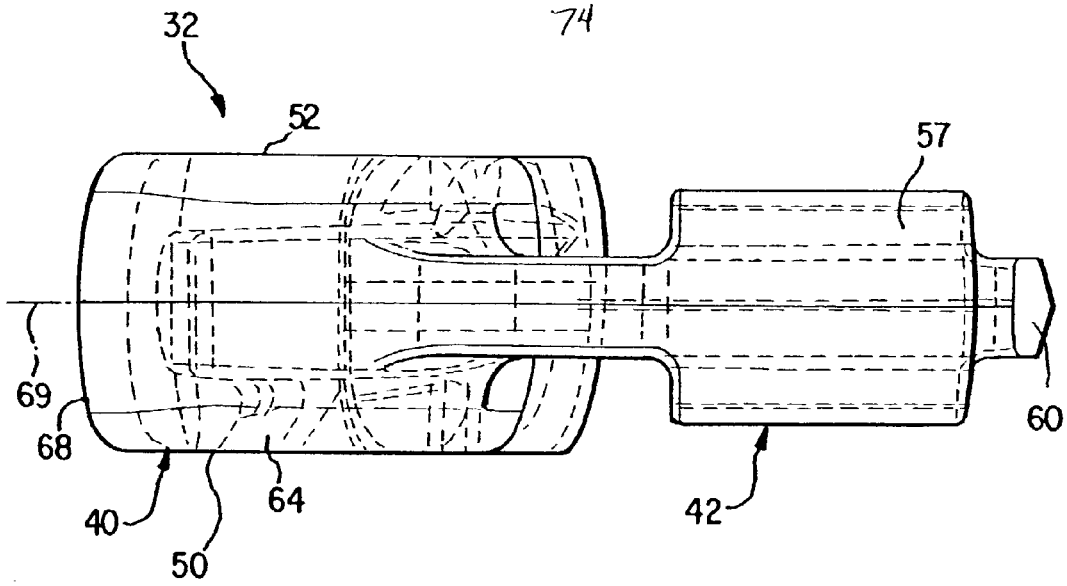
FIG. 3 is a top plan view of the base.
Figure 4:
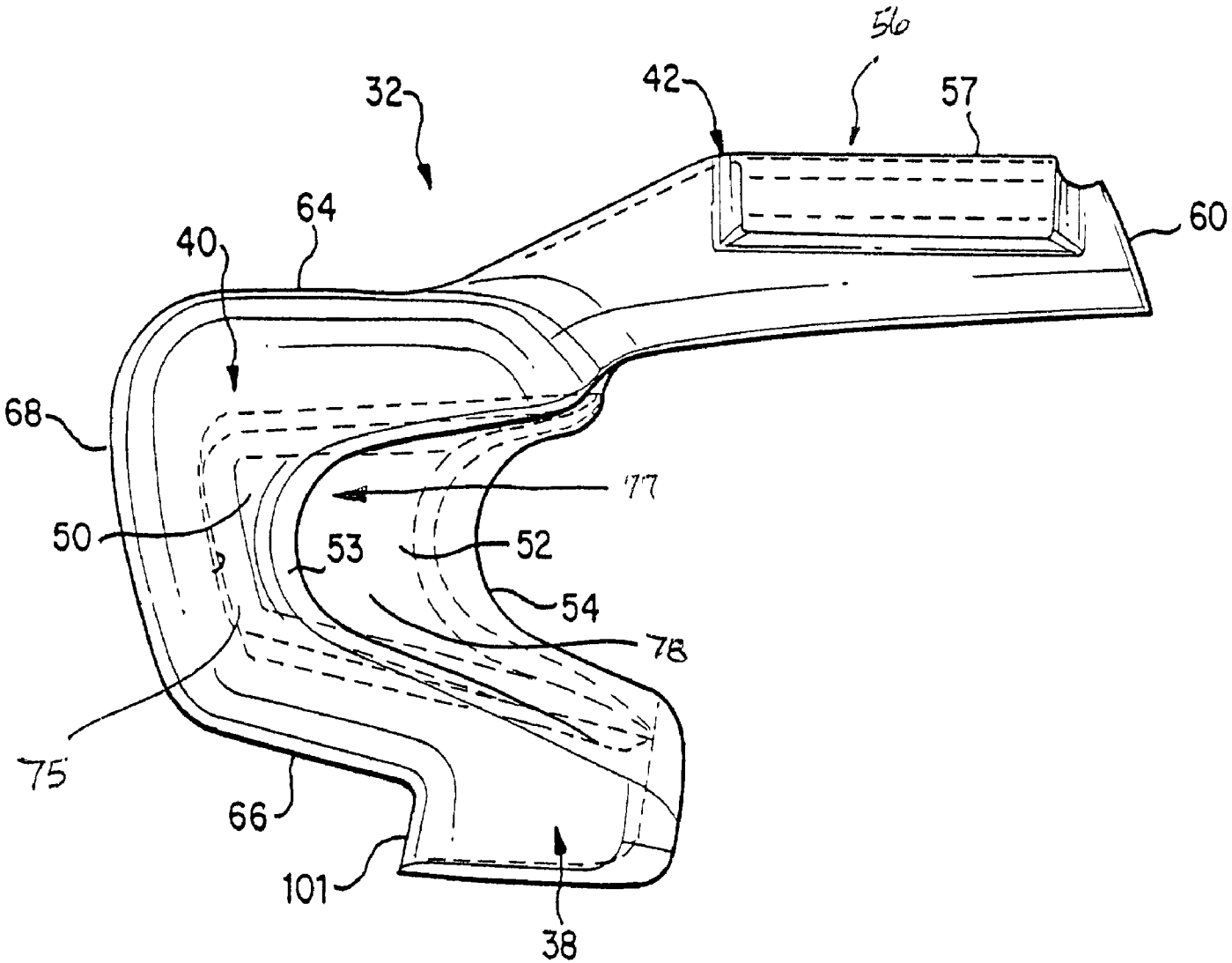
FIG. 4 is a side elevational view of the base.

Upper leg 42 extends rearward of body 40 along upper side 55 of the arm to define coupling configuration 56 for securing the adapter. The coupling configuration is preferably an axial T-shaped tongue 57 that slidably engages a complementary construction 58 on adapter 34. Nonetheless, other constructions provided with at least one laterally extending shoulder could be used to couple the adapter and the base. As examples, the coupling configuration 56 could be formed as other generally T-shaped tongues such as a dovetail tongue and other tongues that laterally broaden in a symmetrical manner, other non-symmetrical shaped tongues, or a slot having T, dovetail or other shape. In any event, the upper leg preferably extends initially upward above body 40 to enable the adapter to slide past the body and couple with the tongue. The rear end wall of upper leg 42 defines a rear bearing surface 60 adapted to engage lock 36. As discussed more fully below, the rear bearing surface is preferably curved and most preferably defines a convex spherical segment (FIG. 2). Nonetheless, a flat rear bearing surface could be used, albeit with reduced benefits.

The body 40 projects forward from the front edge 44 of arm 48 to resist the forces applied to the tooth 30 during use. In the preferred construction, the body includes sidewalls 50, 52, top and bottom walls 64, 66 and a front bearing surface 68. The front bearing surface 68 has a convex, curved shape, as discussed more fully below, to maintain a substantially full face contact with a complementary surface on the adapter during transverse loading of the tooth. In the preferred construction, front bearing surface 68 defines a convex spherical segment (as illustrated by the shaded portion in FIG. 2) to accommodate transverse loading in any direction, such as, side loads, upward loads, downward loads or virtually any load that applies a force transverse to the longitudinal axis 69 of the tooth. Nevertheless, bearing surface 68 could be formed with a surface that is curved in both horizontal and vertical directions but is not spherical. In this type of construction the radii of curvature for either or both curved directions could be fixed or variable. Moreover, the bearing surface 68 could be provided with a curved shape in only one direction, although with reduced benefits. For instance, bearing surface 68 could be curved in only a horizontal or vertical direction or in any particular desired direction. However, when curved in only one direction, the desired full face contact can only be maintained for transverse loading in the same general direction as the curvature of the bearing surface.

The radius (or radii) of curvature defining bearing surface 68 is based upon the relative gap that exists between the base and the adapter. For instance, a clearance is formed between the parts to ensure the adapter can be coupled to the base, especially along the coupling configuration. When a lateral load is applied to the tooth tip, the adapter will rotate until the gaps along the sides close at diagonally opposing corners forming a couple to oppose the lateral load. If the gap between the base and the adapter is the same along the front end and the rear end of base 32, then the center of rotation of the adapter will be at about the mid point M of base 32 (i.e., the mid point between bearing surfaces 60, 68). However, if the gap is smaller at one end as compared to the other end, then the center of rotation will be closer to the end with the smaller gap depending on the amount of the disparity between the parts, i.e., the greater the disparity in the gaps, the greater the center of rotation shifts toward the end with the smaller gap. In the preferred construction, the center of rotation is used as the imaginary center point for the radius of curvature. As can be appreciated, the differences in the clearance along the sides could be different than the clearance along the top and bottom of the base and adapter. In this construction, the curvature in the horizontal direction is preferably different than the curvature in the vertical direction so as to correspond to the spacing of the different clearances.

In the preferred construction, as shown in FIG. 2, the rear bearing surface 60 is curved in the same way as front bearing surface 68, although they could be different. Accordingly, the rear bearing surface can be varied in the same manner as discussed above for front bearing face 68 (e.g., with curves in one or more directions). Preferably, the rear and front bearing surfaces 60, 68 are defined by radii of curvature that initiate from the same point that matches the center of rotation of the adapter. However, due to unavoidable deflection of the parts under heavy loads, there can be some divergence of the points defining the radii of curvature for the front and rear bearing surfaces. Further, rear bearing surface 60 can have a widely different starting point for defining the radius of curvature, or it can even be flat, though such a construction will impose higher stresses on the lock and rear of the base. Hence, the front and rear bearing surfaces may have the same curvature, but also may simply have corresponding curvatures, i.e., where the radius of curvature originates at the same point even though they may each have different lengths. For example, if the center of rotation of the adapter, as discussed above, is closer to the rear end than the front end, then rear bearing surface 60 will preferably have a smaller radius of curvature than front bearing surface 68.

Figure 5:
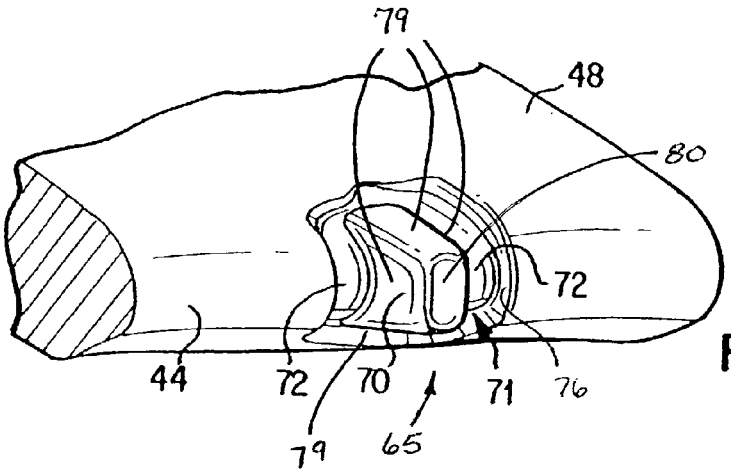
FIG. 5 is a perspective view of a portion of an arm of a dredge cutterhead in accordance with the present invention.
Figure 6:
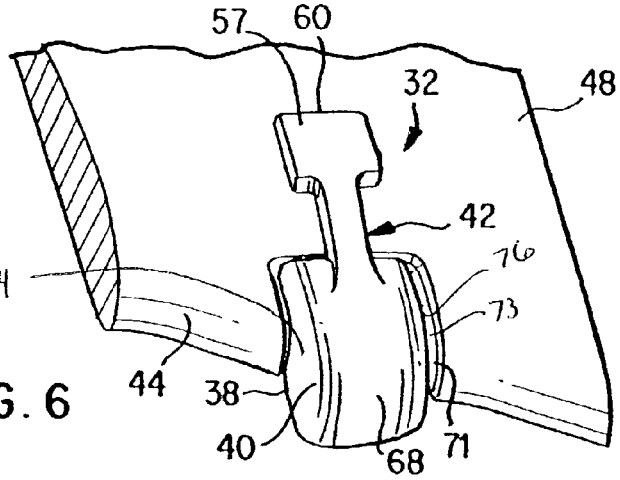
FIG. 6 is a top perspective view of the base positioned on the arm.

The front edge 44 of arm 48 is preferably provided with a plurality of spaced apart locator formations 65 for mounting the excavating teeth. In a preferred embodiment, each locator formation includes a locator nose 70 (FIG. 5) that projects from a recess 71. In the preferred construction, each locator nose is cast as part of the arm with a particular shaped core in the mold. The core is placed in the mold in the orientation needed for positioning each tooth properly on the arm. In this way, there are no difficulties in positioning the adapters on the arms. The locator noses 70 cast in the arm 48 already provides the desired orientation for the tooth.

In the preferred construction, the locator nose projects from a recess 71 formed in the front edge of arm 48. The trough surfaces 72 in the bottom of the recesses oppose the inner edges 53, 54 of the sidewalls 50, 52 of the body of the base preferably leaving a small gap. This gap also enables the operator to more easily cut the base from the arm if needed. A space 73 preferably exists between the outer surfaces 74, 75 of sidewalls 50, 52 and the bevel surfaces 76 to accommodate the application of a weld. The base includes a coupling formation that interacts with the locator formations 65 to properly position the excavating tooth for maximum cutting efficiency. In this construction, the body 40 of base 32 defines a pocket 77 that matingly receives the locator nose 70 to properly position and support the base on the arm. The side faces 79 and free end face 80 of nose 60 fit against complementary surfaces defining pocket 77 to properly orient the tooth on the arm and provide support for the boss in addition to the welds. For this reason, noses 70 preferably have a considerable forward extension. In a preferred construction, the noses extend approximately 1.50 inches beyond trough surfaces 72 and within a range of about 0.75 to 2.25 inches. Nevertheless, lesser or greater nose extensions could be used.

Figure 7:
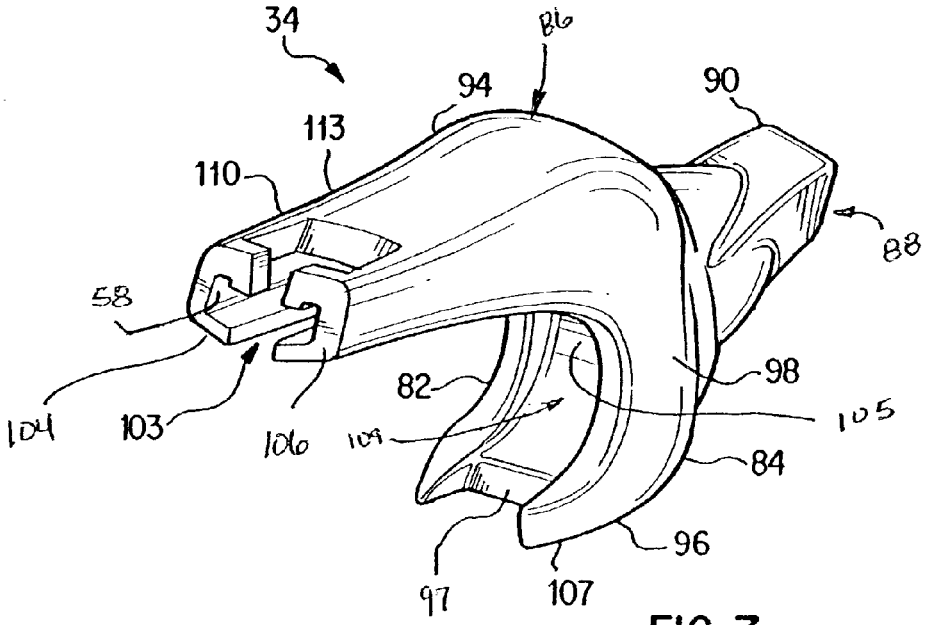
FIG. 7 is a rear perspective view of an adapter in accordance with the present invention.
Figure 8:
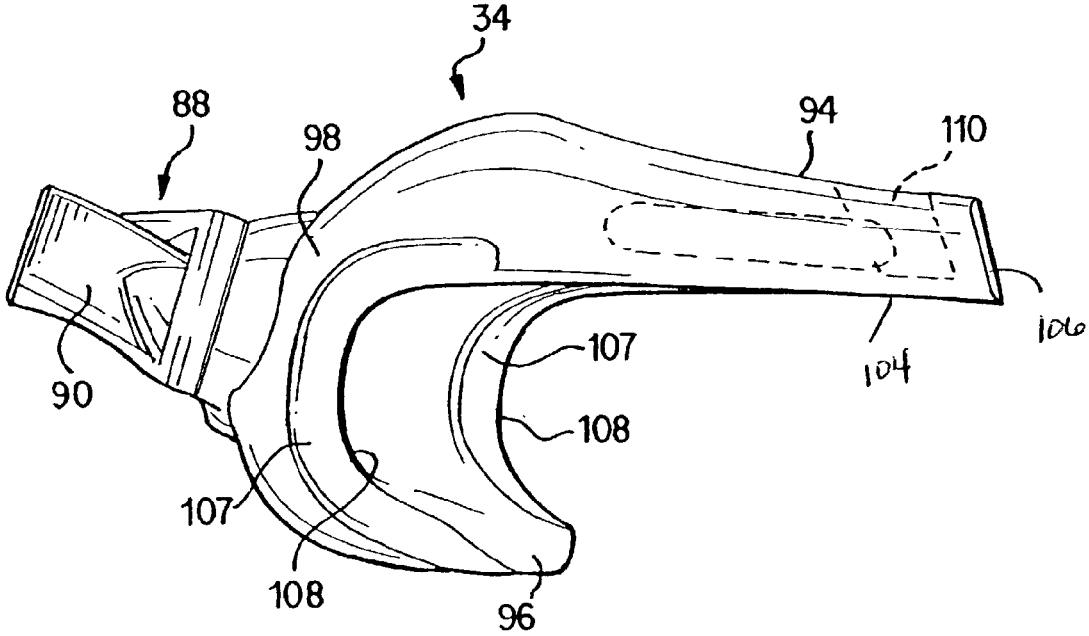
FIG. 8 is a side elevational view of the adapter.
Figure 9:
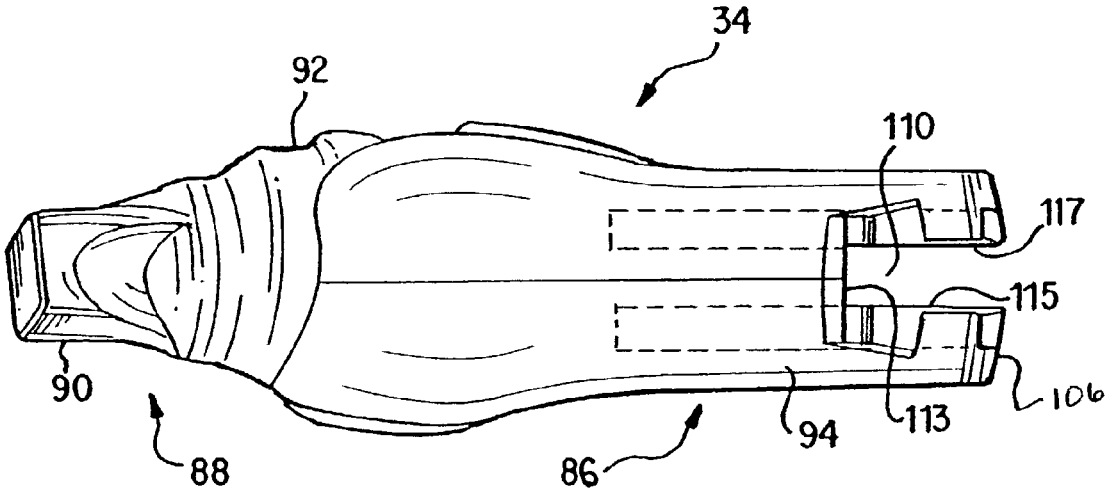
FIG. 9 is a top plan view of the adapter.
Figure 10:
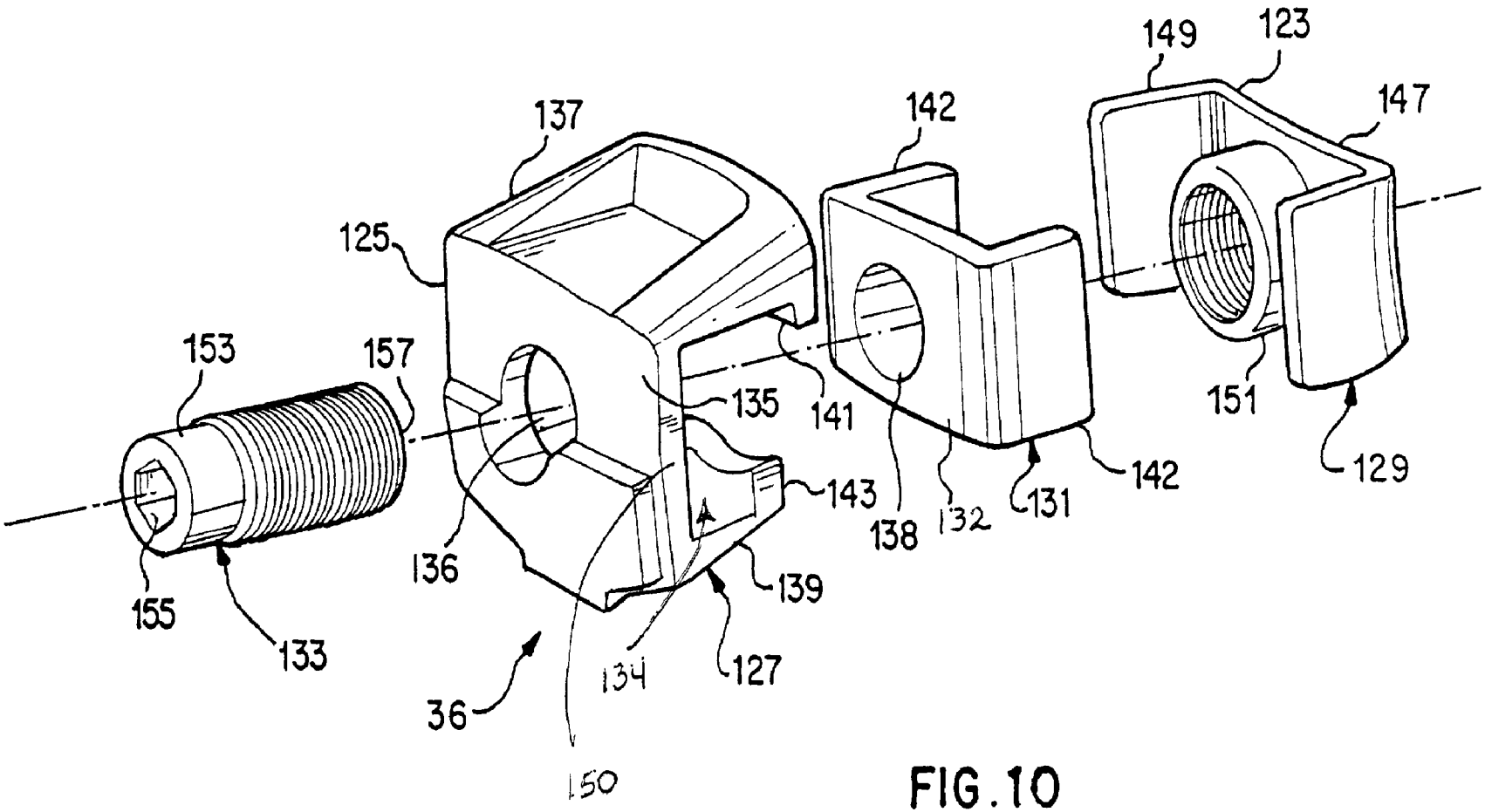
FIG. 10 is an exploded perspective view of a lock in accordance with the present invention.
Figure 11:
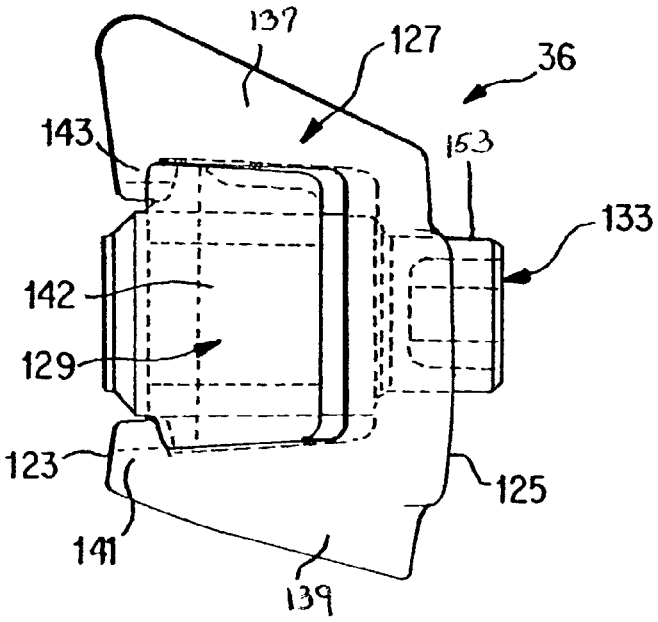
FIG. 11 is a side elevational view of the lock.
Figure 12:
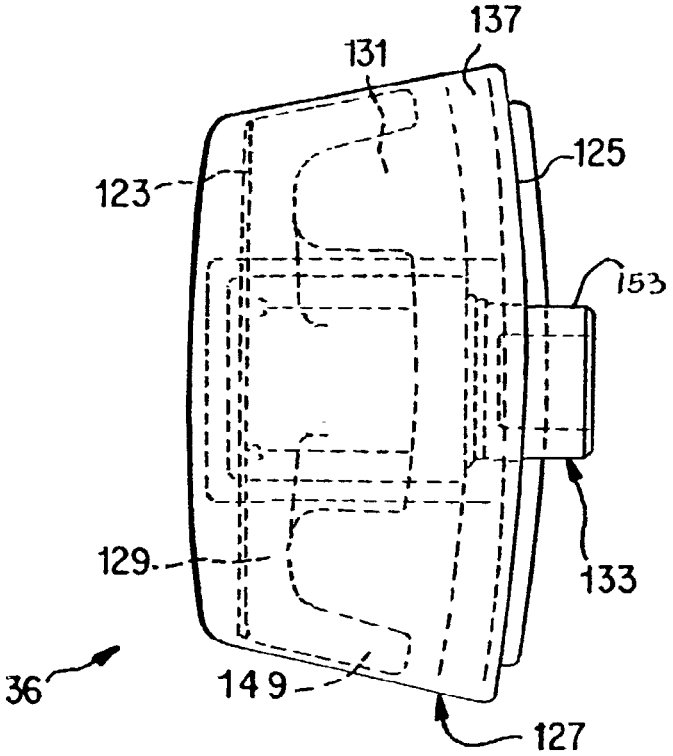
FIG. 12 is a top plan view of the lock.
Figure 13:
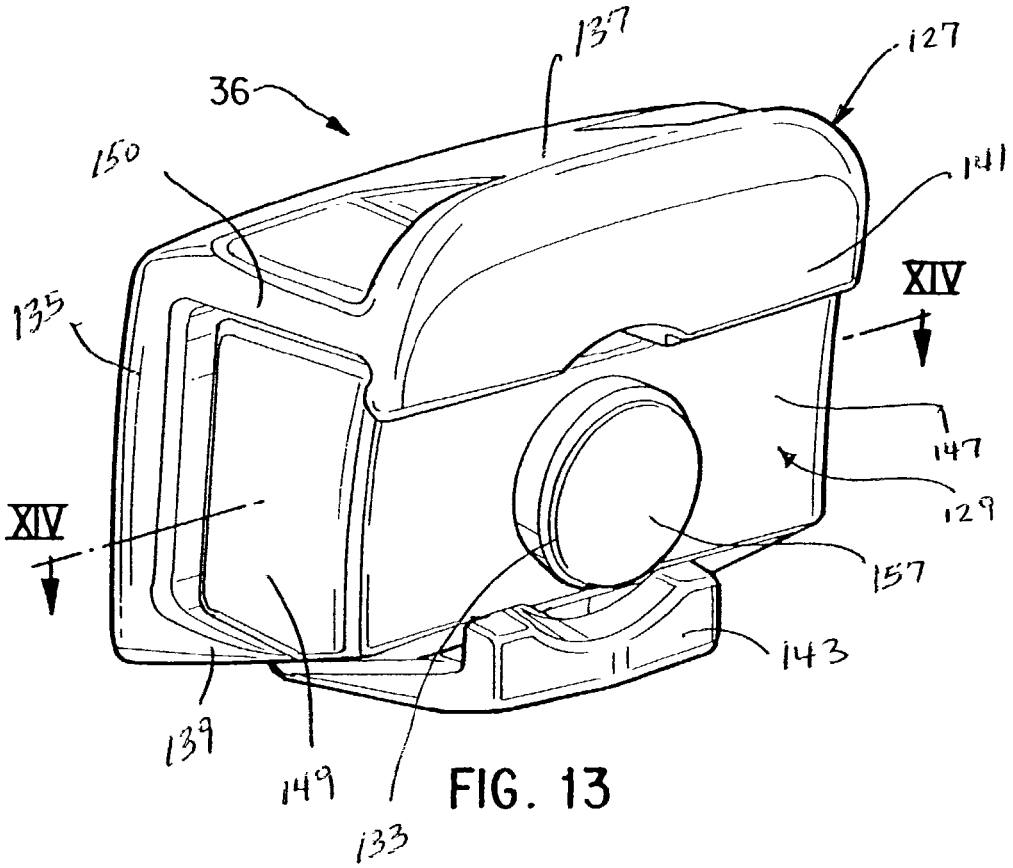
FIG. 13 is a perspective view of the lock.

The wear member in the form of adapter 34 (FIGS. 1 and 7–9) has a rear portion 86 that mounts to base 32 and a front portion 88 for holding a point or tip (not shown). In the preferred construction, the front portion includes a forwardly projecting nose 90 that is received into the socket of a point. The nose can have any configuration for mounting a point. In this embodiment, the front portion further includes a slot 92 for receiving a lock pin (not shown) to hold the point to the adapter. The rear portion 86 includes an upper leg 94, a lower leg 96, and a mid portion 98. Lower leg 96 of adapter 34 overlies bottom wall 66. The rear end 97 of leg 96 opposes front wall 101 of the base so that under extreme loads wall 101 functions to stop the shifting of the adapter on the base. Upper leg 94 extends rearward to overlie top wall 64 and upper leg 42 of base 32. The upper leg of adapter 34 includes a coupling configuration 58 that is adapted to mate with the coupling configuration 56 of base 32. Hence, the coupling configuration of adapter 34 can be varied in the same way as the coupling configuration for base 32. In the preferred construction, upper leg 94 includes a T-shaped slot 103 that matingly receives T-shaped tongue 57. The T-shaped slot 103 is open along the inner surface 104 and in the rear wall 106 of upper leg 94 to facilitate receipt of tongue 57. Ribs 107 are preferably formed along the inner edge 108 of mid portion 98 for enhanced strength to resist cracking during use (FIGS. 1, 7 and 8).

The mid portion 98 of adapter 34 includes an interior recess 109 having an abutment or abutting surface 105 adapted to abut front bearing surface 68 of base 32. Abutment 105 is arcuate and concave in shape to match the arcuate front bearing surface 68. Accordingly, abutment 105 and bearing surface 68 each preferably define a spherical segment with essentially the same radius of curvature, although the curves could differ within a certain range of values primarily because of deflection that occurs in the parts under heavy loading. As discussed above, the preferred shape of abutment 105 and bearing surface 68 is defined by a radius of curvature that is determined by the clearance between the front and rear end portions of the adapter and base. In the most preferred configuration, the gaps between the base and the adapter are uniform from front to back along the sides and along the top and bottom so that the curved bearing surfaces 68, 105 each define a spherical segment. The actual desired size of the radius of curvature defining the spherical segments would depend on the gaps as well as the actual size of the part. As a general rule, the radius of curvature defining surfaces 68, 105 is preferably not larger than the length of base 32 (i.e., the distance between rear and front bearing surfaces 60, 68) to avoid having too broad of an arc.

Figure 15:
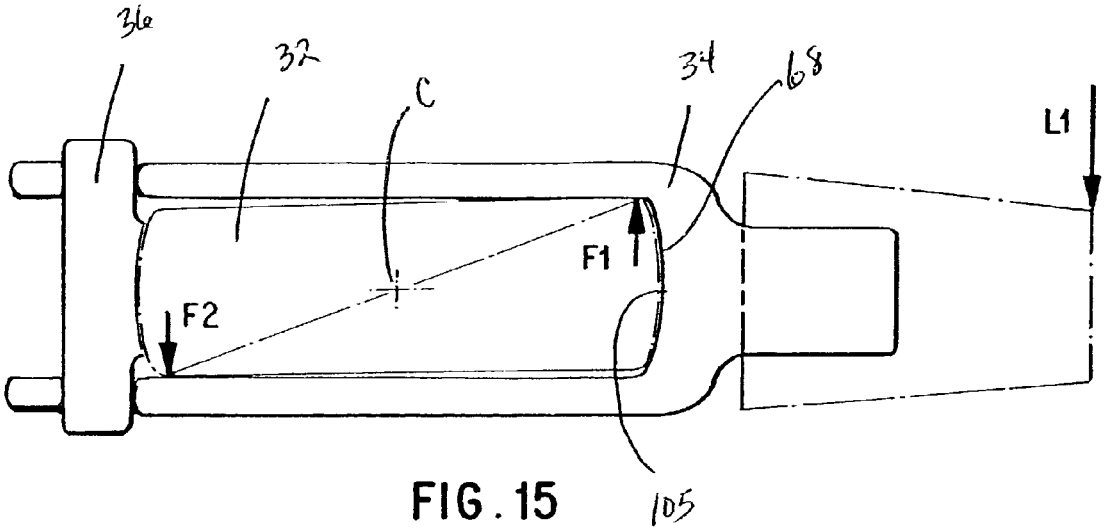
FIG. 15 is a top schematic view of a tooth in accordance with the present invention under side loading.
Figure 16:
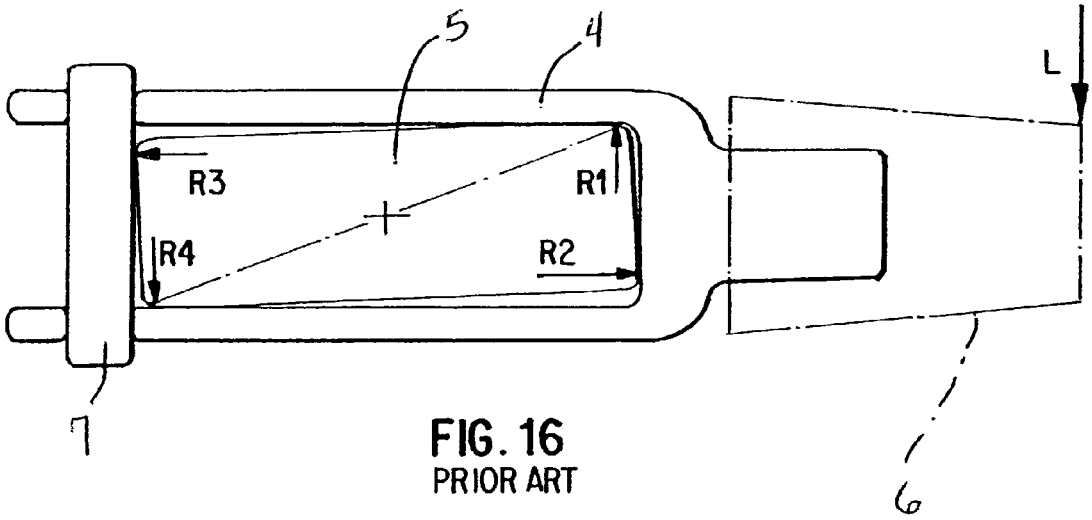
FIG. 16 PRIOR ART
FIG. 16 is a top schematic view of a prior art tooth under side loading.
Figure 17:
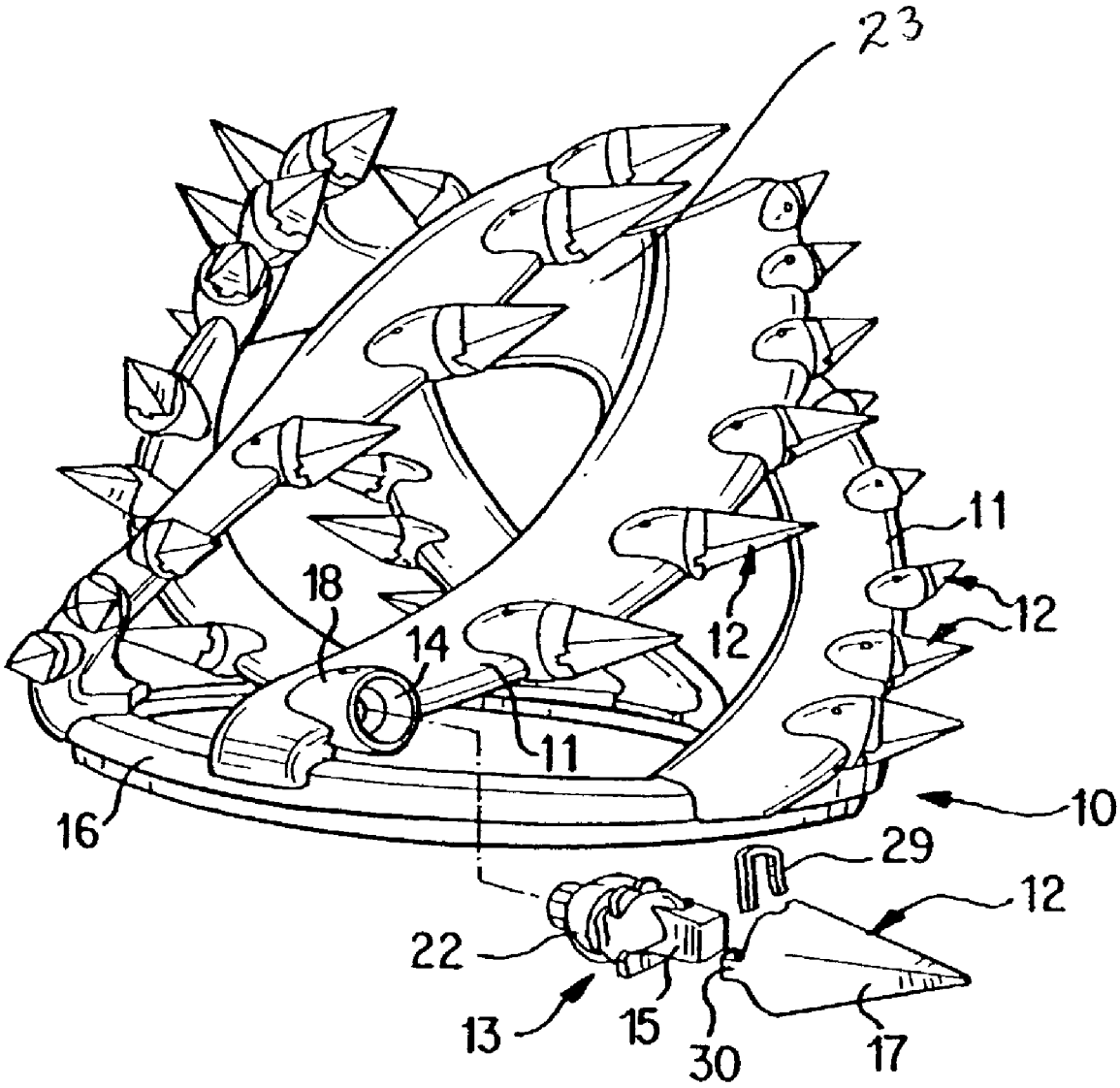
FIG.17 PRIOR ART
FIG. 17 is a perspective view of a prior art dredge cutterhead.
Figure 18:
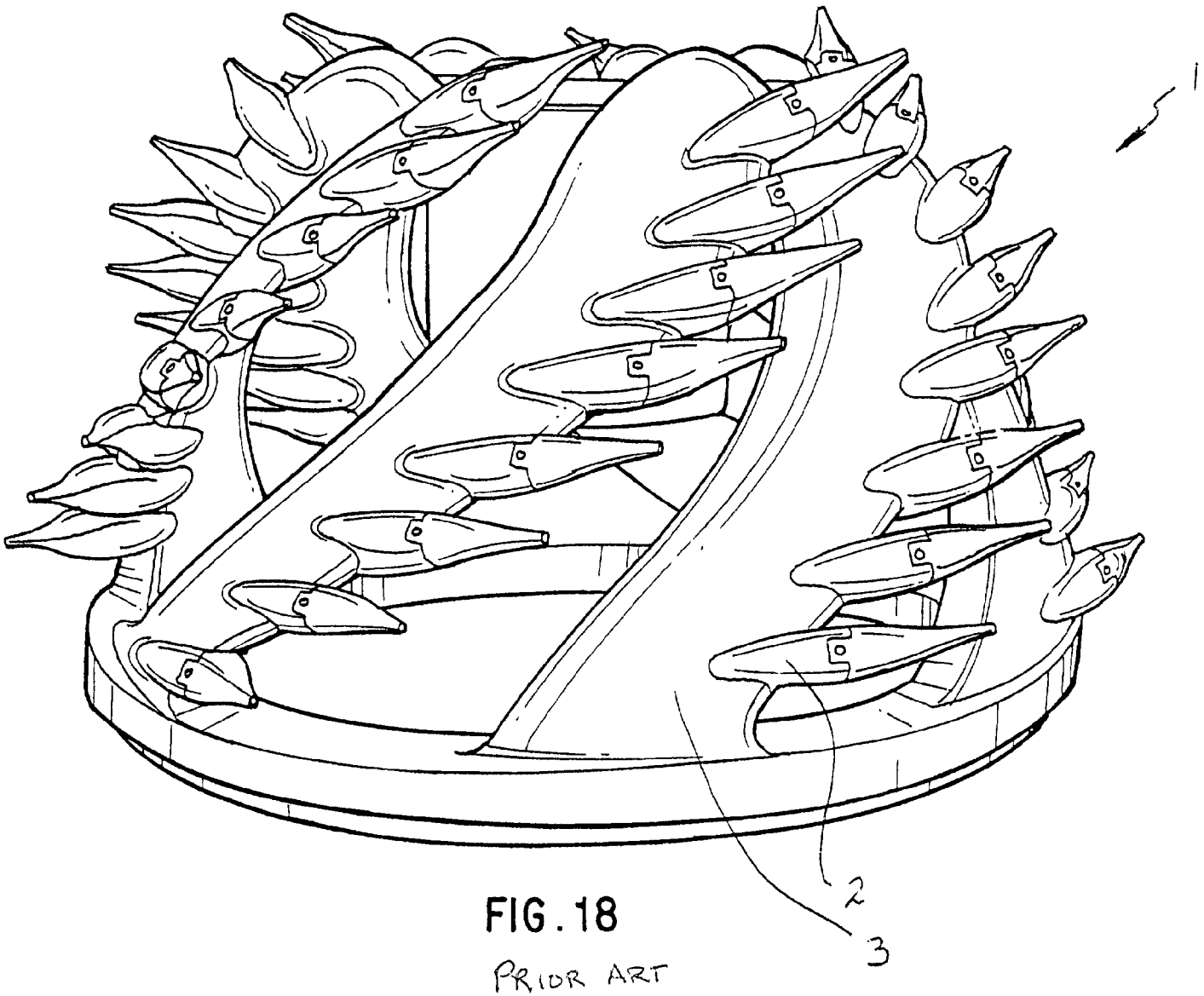
FIG. 18 PRIOR ART
FIG. 18 is a perspective view of another prior art dredge cutterhead.

As seen in FIG. 15, a side load L1 tends to rotate adapter 34 relative to base 32 about a center of rotation C. The radius of curvature defining bearing surfaces 68, 105 originate from the same center of rotation. Because of the mating arcuate configuration of abutment 105 and bearing surface 68, these surfaces remain in essentially full bearing contact with each other. Accordingly, no forces are applied as point contacts in the axial direction to prematurely wear the parts. Instead, the axial loads are spread out over substantially the whole of the abutment 105 and bearing surface 68 to greatly reduce the stress in the parts. As a result, the high stresses accompanying resultant forces R2, R3 (FIG. 16) are essentially eliminated.

Adapter 34 further includes an opening 110 in a rear portion of upper leg 94 (FIGS. 1 and 7–9). In the preferred construction, opening 110 has a generally rectangular configuration with a curved front wall 113 and a curved rear wall 115. Nevertheless, it is not necessary that the walls be curved or that the opening has an overall generally rectangular configuration. Rather, the opening can have virtually any shape so long as it receives the lock which, in turn, secures the adapter to the base. If there is any shifting of adapter 34 during use, the lock 36 tends to move with the adapter. Hence, there is ordinarily no significant shifting between the lock and the adapter and thus no undue wearing therebetween. Rear wall 115 preferably includes a hole 117 that extends through the rear end 106 of upper leg 94 to accommodate an adjustment assembly of lock 36. Nevertheless, hole 117 could have a variety of different shapes or be eliminated if an adjustment assembly is not used or one is used that does not require the space provided by hole 117.

Lock 36 is adapted to be received in opening 110 (FIGS. 1 and 10–14). In the preferred construction, lock 36 has a generally rectangular configuration with a curved front wall 123 and a curved rear wall 125 to match the configuration of opening 110. Although shifting between the adapter and lock is not likely, the curved walls 115, 125 tend to reduce any wearing in the event shifting occurs. Nevertheless, lock 36 may have a varied shape in the same way as discussed above for opening 110.

In the preferred construction, lock 36 comprises an outer part 127, an inner part 129, a resilient member 131 and an actuator, preferably in the form of a screw 133. Outer part 127 defines a cavity 134 for receiving the inner part 129 and resilient member 131. In general, outer part 127 is generally C-shaped to include a base wall 135, a top wall 137 and a bottom wall 139. A pair of lips 141, 143 extends toward each other from the top and bottom walls 137, 139 to contain the inner part 129 and resilient member 131 in cavity 134. Base wall 135 includes an aperture 136 for receiving screw 133. The inner part also has a generally C-shaped configuration with a center wall 147 and two sidewalls 149. The two C-shaped components fit together to generally define a box-like shape. In the preferred curved construction, sidewalls 149 are at obtuse angles to center wall 147 to match the side edges 150 of outer part 127. An internally threaded boss 151 extends rearward from the center of center wall 147 to receive screw 133. Resilient member 131 is preferably an elastomer. In the preferred construction, the elastomer is composed of neoprene or rubber, although other types of elastomeric materials can be used. The elastomer is shaped for receipt in inner part 129 about boss 151. In the preferred embodiment, resilient member 131 has a base portion 132 with an aperture 138 and a pair of arm portions 142. Nevertheless, other shapes could be used. Moreover, other kinds of resilient members could be used, such as Bellville springs or a coiled spring.

The lock is assembled by placing the resilient member 131 about boss 151 in inner part 129. The combined inner part and resilient member are then inserted laterally into the side of cavity 134 in outer part 127, i.e., by side edges 150. Once boss 151 is aligned with aperture 136, screw 133 is preferably back threaded into boss 151 until it is received into aperture 136. The screw ensures that the component parts do not become inadvertently disassembled.

In use, lock 36 is inserted into opening 110 after adapter 34 is placed over base 32 with tongue 57 received in slot 103 (FIG. 1). Screw 133 includes a head 153 with some means for engaging a tool (not shown) for turning the screw. In the preferred embodiment, screw head 153 has internal flats 155 for receiving an appropriate wrench. The free end of screw 133 includes a bearing surface 157 that abuts rear bearing surface 60 when the screw is advanced.

Further advancement of screw 133 against rear bearing surface 60 causes the rear face 125 of base wall 135 to push rearwardly against the rear wall 115 of opening 110. This expansion of the lock results in abutment 105 of adapter 34 being brought into tight abutting relationship with front bearing surface 68 of base 32. Further advancement of screw 133 following such abutment will then cause the inner part 129 to move toward the outer part 127 to compress resilient member 131 until sidewalls 149 abut base wall 135. The sidewalls will abut base wall 135 to prevent over-compression of the resilient member. If the elastomer is a non-compressible rubber material or the like, there is enough open space between the inner and outer parts to permit the inner part 129 to be drawn against the outer part 127. Depending on the resistance in coupling the adapter to the base, the resilient member may compress in some instances before the adapter is fully tightened onto the base. In any event, with inner part 129 in abutting contact with outer part 127, lock 36 initially is a rigid lock member. As wear begins to develop between adapter 34 and base 32, resilient member 131 expands to dampen movement of the adapter relative to the base and maintain a tight relationship between the components of the tooth. This expansion of lock 36 continues to hold the components tightly together until resilient member 131 reaches its fully expanded position (i.e., when the inner part abuts against lips 141, 143).

Figure 14:
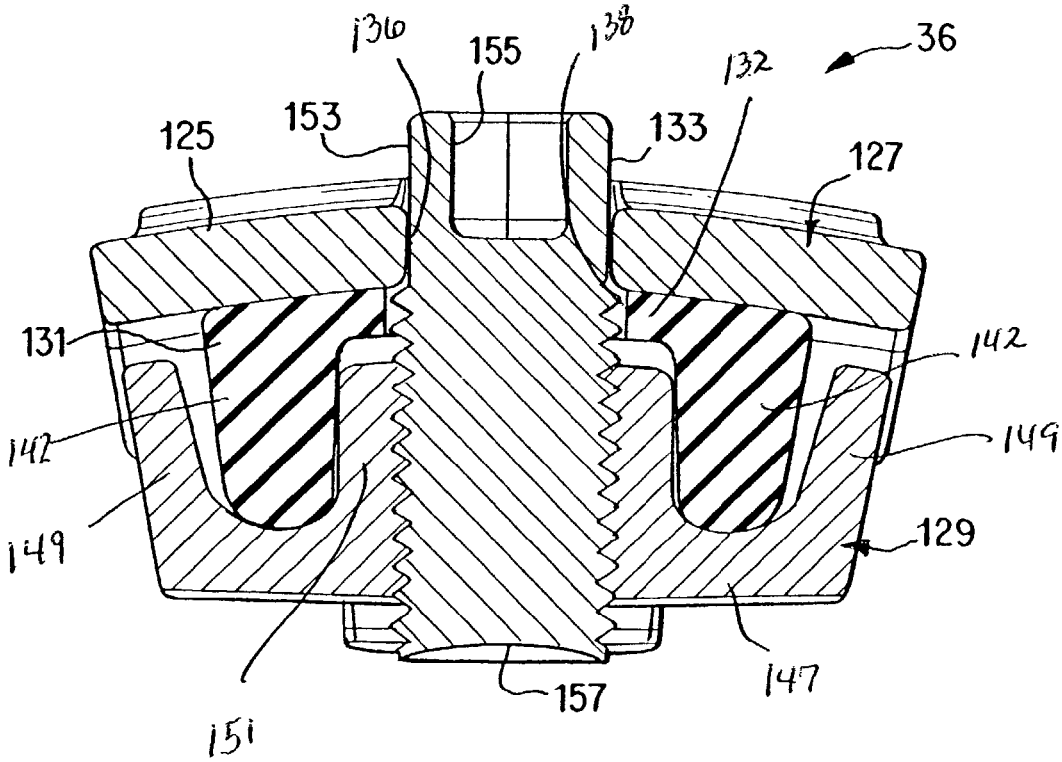
FIG. 14 is a cross-sectional view of the lock taken along line XIV—XIV in FIG. 13.

Bearing surface 157 on screw 133 preferably has a concave, arcuate surface to engage the corresponding rear bearing surface 60 (FIG. 14). In the most preferred construction, bearing surface 60 and 157 are each formed as a spherical segment. In this way, bearing surface 157 remains in substantially full contact with rear bearing surface 60 as adapter 34 shifts under transverse loading (i.e., as the adapter rotates about its center of rotation). While bearing surfaces 60 and 157 can be formed with the same radius of curvature, bearing surface 157 of screw 133 can alternatively be formed with a smaller radius of curvature so as to contact rear bearing surface 60 with a circular contact. The spherical configuration of the rear base surface still enables the circle contact of screw 133 to remain in substantially full contact with base 32 during any shifting of the adapter.

Alternatively, other locks could be used so long as they abut adapter 34 and base 32 so as to prevent the adapter from sliding forwardly off of the base. For example, a lock with a different adjustment assembly could be used, such as the fluid actuator as disclosed in U.S. Pat. No. 5,653,048 to Jones et al., herein incorporated by reference. Similarly, an opening and lock such as disclosed in U.S. Pat. No. 5,088,214 to Jones et al., herein incorporated by reference, without an adjustment assembly could also be used.

Figure 19:
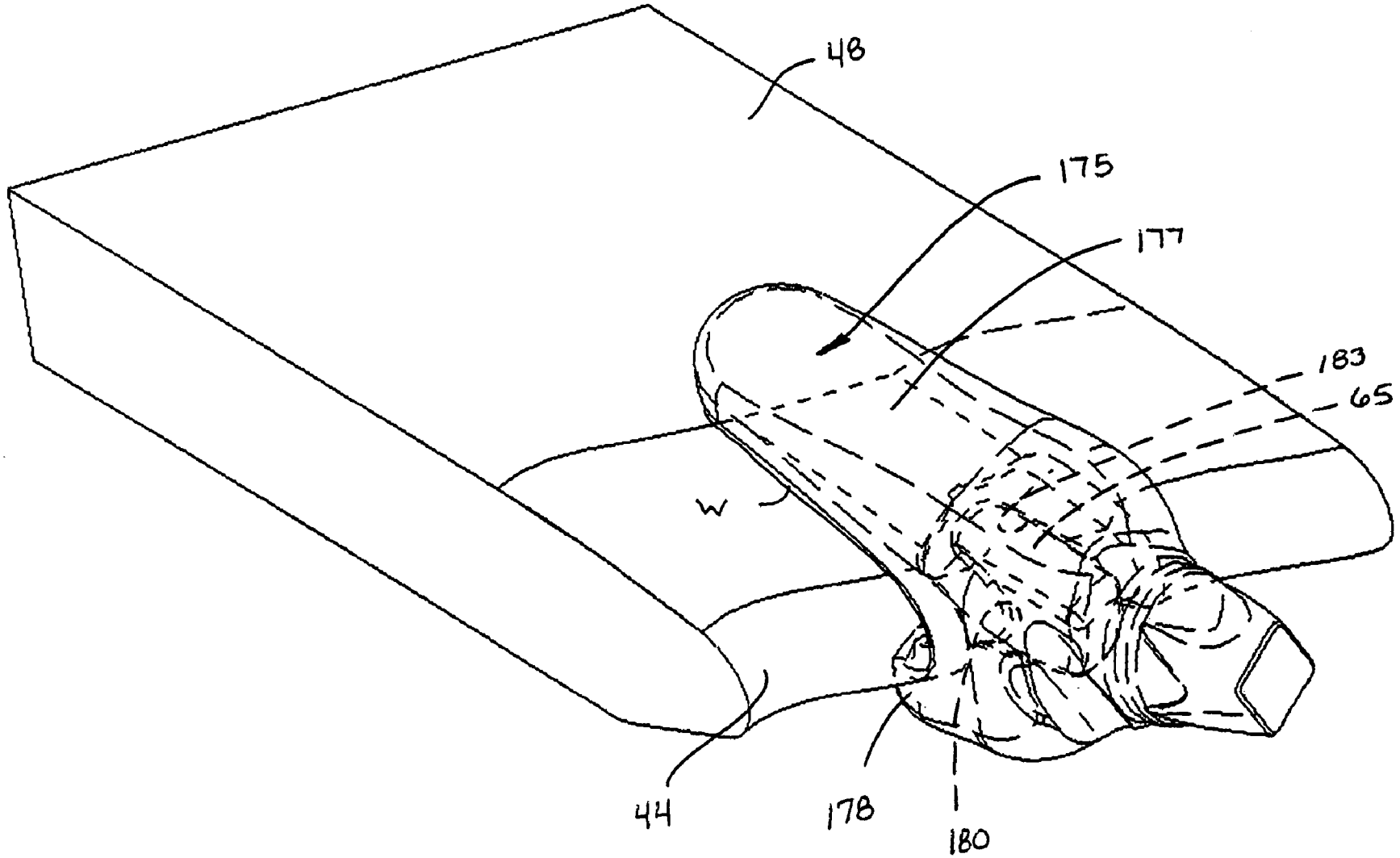
FIG. 19 is a perspective view of a weld-on adapter mounted on a dredge arm in another embodiment.

In an alternative construction, weld-on adapters 175 can be mounted on the locator formations 65 of the dredge cutterhead arm 48 without bases 32 (FIG. 19). While the use of such adapters does not provide the easy removal and installation procedures of the mechanically attached adapters discussed above, the locator formations still provide easy positioning of the adapters as well as additional support. In a preferred construction, adapters 175 include a pair of bifurcated legs 177, 178 that straddle the arm, although a single leg could be used (not shown). If a single leg is used, the leg will preferably be located on the upper side of the arm to enable easier welding of the adapter to the arm. The adapter includes a coupling formation 180 to matingly fit with the locator formations 65 so as to properly position the adapter, and thus, the tooth point (not shown) for maximum digging efficiency. As with base 32, adapters 175 include a pocket 183 that matingly receives nose 70 with surfaces that oppose side faces 79 and end face 80 to properly position and support the adapter in use. The adapter is then welded along all or parts of its periphery. Also, as with boss 32, the adapter is preferably spaced from the trough surfaces 72 for easier removal of the adapter from the arm.

Figure 20:
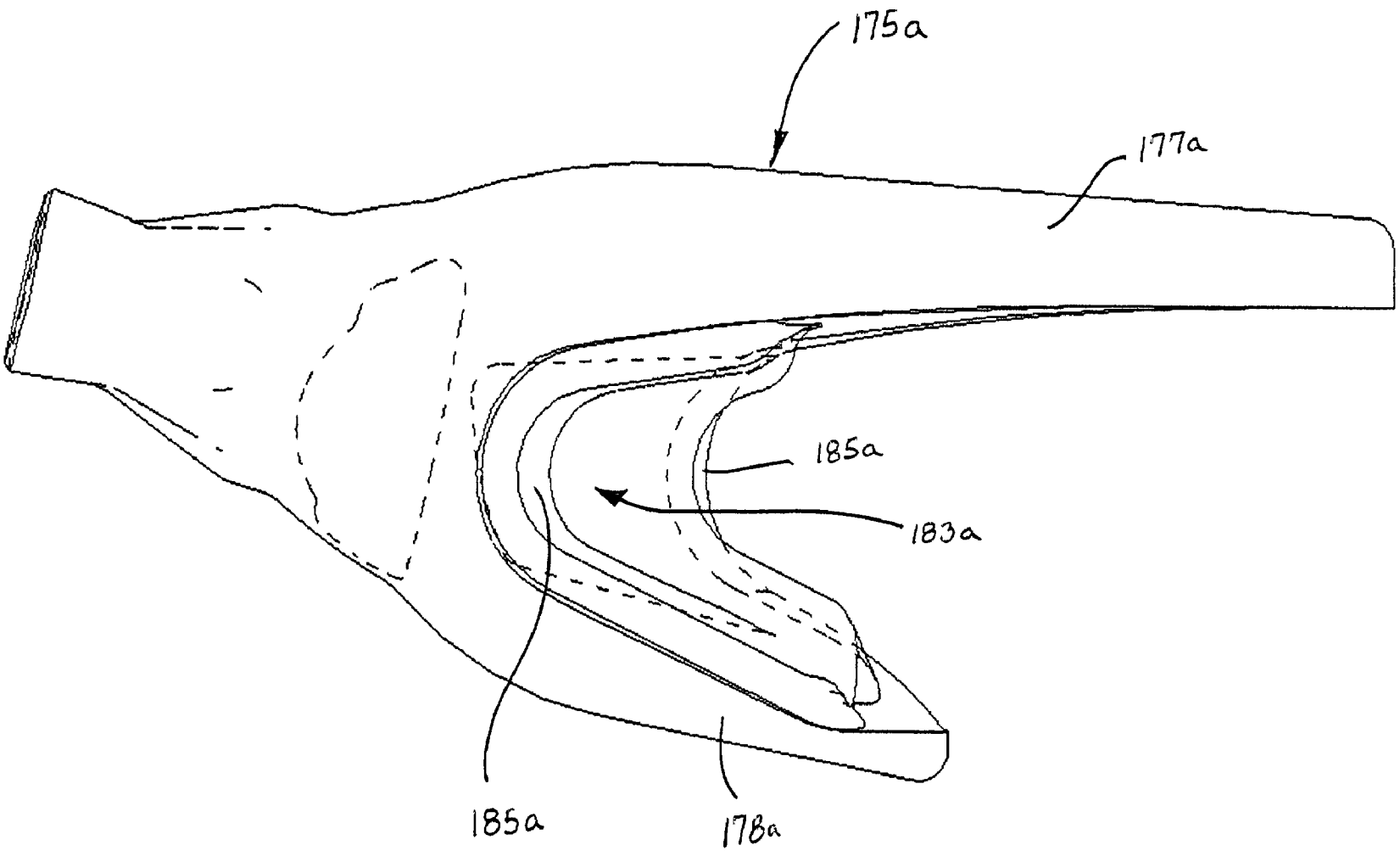
FIG. 20 is a side view of an alternative weld-on adapter.

In another alternative construction, adapter 175*a* includes a coupling formation 180*a* that does not rely upon nose 70 for positioning and support (FIG. 20). In this arrangement, each locator formation includes a pair of spaced apart surfaces having a particular shape and spacing to engage, support and properly position a wear member. For example, trough surfaces 72 to each side of nose 70 are formed with a shape that matches the inner edge surfaces of the bight 185*a* interconnecting legs 177*a*, 178*a*. The bight surface 185*a*, then, sets against trough surfaces to properly orient the tooth. An adapter with coupling formation 180*a* can include an enlarged pocket 183*a* that does not engage nose 70 or can be used with an arm that does not include a nose 70.

In another alternative construction, another weld-on adapter can be fit over base 32. In this construction, the adapter includes a pocket that matingly receives body 40 and includes a configuration, such as a recess, that enables the arm to fit over but not connect to the tongue of base 32. Alternatively, a base without a leg or with a leg having no coupling tongue could be used with such a weld-on adapter. In either case, the body 40 of base 32 properly orients and provides support to the adapter, which is then welded to the arm.

The above-discussion concerns the preferred embodiments of the present invention. Various other embodiments as well as many changes and alterations may be made without departing from the spirit and broader aspects of the invention as defined in the claims.

The invention claimed is:

1. A wear member for attachment to an excavator on which is fixed a base having a forwardly directed convex bearing face, the wear member comprising a rear mounting portion that wrape at least partially about the base, a front working portion, and a rearward facing abutting surface adapted to abut the bearing face of the base, the abutting surface being concave and curved generally about two generally perpendicular axes so as to define generally a bowl-like surface with which to engage the convex bearing face of the base.

2. A wear member in accordance with claim 1 further comprising an opening for receiving a lock to secure the wear member to the base.

3. A wear member in accordance with claim 2 wherein the rear mounting portion includes a leg that extends rearward over a portion of the excavator.

4. A wear member in accordance with claim 3 wherein the leg includes an inner surface to set along the excavator, a rear wall extending outward from the excavator, and a slot opening in the inner surface and the rear wall to receive at least a portion of the base having a complementary shape.

5. A wear member in accordance with claim 4 wherein the slot includes an internal shoulder to prevent release from the base in a direction other than in a longitudinal direction.

6. A wear member in accordance with claim 5 wherein the slot has a generally T-shaped configuration.

7. A wear member in accordance with claim 3 wherein the opening is defined in the leg.

8. A wear member in accordance with claim 2 wherein the opening has a front wall portion and a rear wall portion, the rear wall portion is adapted to oppose the lock to thereby hold the wear member to the excavator, and the rear wall portion is concave and curved.

9. A wear member in accordance with claim 8 wherein the curvature of the rear wall portion is defined by a first radius of curvature and the curvature of the abutting surface is defined by a second radius of curvature, and wherein the first and second radii of curvature each originate from substantially the same location.

10. A wear member in accordance with claim 9 wherein the abutting surface and the rear wall portion each define a generally spherical segment.

11. A wear member in accordance with claim 2 further including a coupling configuration adapted to engage a complementary portion of the base and prevent release of the wear member from the base in a direction other than a longitudinal direction.

12. A wear member in accordance with claim 11 wherein the coupling structure is one of a tongue or a slot provided with a shoulder that engages a complementary portion of the base.

13. A wear member in accordance with claim 2 wherein the abutting surface defines a spherical segment.

14. A wear member in accordance with claim 2 in which the opening includes a transverse segment and an axial segment that opens in a rear wall of the wear member.

15. A wear member in accordance with claim 2 in which the opening has a rear wall with a curved configuration for bearing against the lock.

16. A wear member in accordance with claim 2 in which the front working portion includes a nose for mounting a tooth point.

17. A wear member in accordance with claim 1 further comprising a rearward facing recess for receiving side portions of the base, the recess containing the abutting surface.

18. A wear member in accordance with claim 17 wherein the recess is defined in part by sidewalls each provided with a concave edge surface that wraps around the digging edge of the excavator, and wherein each said edge surface includes ribs to reduce cracking during use.

19. A wear member in accordance with claim 17 wherein the recess is defined in pert by sidewalls each provided with a concave edge surface that wraps around the digging edge of the excavator, and wherein each said edge surface includes laterally flattened surfaces to abut the digging edge and thereby property orient the wear member on the digging edge.

20. A wear member in accordance with claim 1 wherein the rear mounting portion includes a slot adapted to receive a tongue formed on the base.

21. A wear member in accordance with claim 20 wherein the slot includes at least one internal shoulder to engage a complementary portion of the tongue to prevent release from the base in a direction other than in a longitudinal direction.

22. A wear member in accordance with claim 21 wherein the slot has a generally T-shaped configuration.

23. A wear member in accordance with claim 1 wherein the mounting portion includes a coupling structure adapted to engage the base and prevent release of the wear member from the base in a direction other than in a longitudinal direction.

24. A wear member in accordance with claim 23 wherein the coupling structure is one of a tongue or a slot provided with a shoulder that engages a complementary portion of the base.

25. A wear member in accordance with claim 24 wherein the coupling structure has a generally T-shaped configuration.

26. A wear member in accordance with claim 1 further comprising a rearward facing recess for receiving at least a portion of the base, the recess containing the abutting surface.

27. A wear member in accordance with claim 26 wherein the recess is defined in part by sidewalls each provided with a concave edge surface that wraps around a digging edge of the excavator, and wherein each said edge surface includes ribs to reduce cracking during use.

28. A wear member in accordance with claim 26 wherein the recess is defined in part by sidewalls each provided with a concave edge surface that wraps around a digging edge of the excavator, and wherein each said edge surface includes laterally flattened surfaces to abut the digging edge and thereby properly orient the wear member on the digging edge.

29. A wear member in accordance with claim 1 wherein the abutting surface has a generally spherical configuration.

30. A wear member in accordance with claim 1 further comprising means for securing the wear member to the base.

31. A wear member in accordance with claim 1 wherein the front working portion includes a nose for mounting a point.

32. A wear member in accordance with claim 1 wherein the wear member has a forwardly extending central axis, and a central portion of the abutting surface is generally normal to the central axis.

33. A wear member for attachment to an excavator on which is fixed a base having a forwardly directed convex bearing face, the wear member comprising a rear mounting portion that wraps at least partially about the base, a front working portion, a rearward facing abutting surface adapted to abut the bearing face of the base, the abutting surface being concave and curved generally about a first axis, and an opening for receiving a lock, the opening having a front wall portion and a rear wall portion, the rear wall portion being adapted to oppose the lock to thereby hold the wear member to the excavator, the rear wall portion being concave and curved generally about a second axis generally parallel to the first axis, wherein the curvature of the rear wall portion is defined by a first radius of curvature and the curvature of the abutting surface is defined by a second radius of curvature, and wherein the first and second radii of curvature each originate from substantially the same location.

34. A wear member in accordance with claim 33 wherein the mounting portion includes a leg that extends rearward over a portion of the excavator and includes the opening.

35. A wear member in accordance with claim 34 wherein the leg further includes a slot to receive a portion of the base, and wherein the slot is in communication with the opening.

36. A wear member in accordance with claim 35 wherein the slot opens rearward to receive the base and is oriented generally along a longitudinal axis of the leg.

37. A wear member in accordance with claim 36 wherein the slot includes an internal shoulder to prevent release from the base in a direction other than in a longitudinal direction.

38. A wear member in accordance with claim 37 wherein the slot has a generally T-shaped configuration.

39. A wear member in accordance with claim 33 further comprising a rearward facing recess for receiving at least a portion of the base, the recess containing the abutting surface.

40. A wear member in accordance with claim 39 wherein the recess is defined in part by sidewalls each provided with a concave edge surface that wraps around the digging edge of the excavator, and wherein each said edge surface includes ribs to reduce cracking during use.

41. A wear member in accordance with claim 33 wherein the abutting surface and the rear wall portion each define a generally spherical segment.

42. A wear member in accordance with claim 33 in which the opening includes a transverse segment including the front and rear wall portions, and an axial segment that opens in a rear wall of the wear member.

43. A wear member in accordance with claim 33 in which the front working portion includes a nose for mounting a point.

44. A wear member for attachment to an excavator on which is fixed a base having a front end, the wear member comprising a rear mounting portion for securing the wear member to the excavator, a front working portion, and a rearward facing abutting surface adapted to abut the front end of the base, the abutting surface being concave and curved simultaneously about perpendicular axes.

45. A wear member in accordance with claim 44 further including an opening into which is received a lock for holding the wear member to the base.

46. A wear member in accordance with claim 45 further including a leg having a slot for receiving a complementary portion of the base.

47. A wear member in accordance with claim 45 wherein the opening includes a concave rear wall that opposes the look, the rear wall is at least partially defined by a first radius of curvature, the abutting surface is at least partially defined by a second radius of curvature, and the first and second radii of curvature have generally the same origination point.

48. A wear member in accordance with claim 44 further including a cavity defined by opposing sidewalls and the abutting surface for receiving the base.

49. A wear member in accordance with claim 48 wherein each of the sidewalks includes a rear edge adapted to oppose a digging edge of the excavator, and a rib extending along the rear edge.

50. A wear member in accordance with claim 44 wherein the abutting surface is a continuously curved surface.

51. A wear member in accordance with claim 44 wherein the abutting surface is generally a spherical segment.

52. A wear member in accordance with claim 44 further comprising a generally flat longitudinally extending surface above and below the abutting surface.

53. A wear member in accordance with claim 44 wherein the front working portion is a nose for mounting a further component.

54. A wear member for attachment in a series of identical wear members along a front edge of an arm of a dredge cutterhead, the arm having a plurality of locator formations each having an identical shape that defines a first longitudinal axis extending outward of the arm, each locator formation further having a unique orientation relative to the front edge of the arm such that the first longitudinal axis of each said locator formation intersects the front edge of the arm at an angle that is different from the first longitudinal axis of at least one other locator formation on said arm, each said wear member comprising a front working portion projecting forward of the front edge of the arm and having a second longitudinal axis, a leg extending over a surface of the arm rearward of the front edge, a rearward facing mounting structure that matingly engages the locator formation, the mounting structure including positioning surfaces that contact the locator formation and prevent lateral movement of each said wear member along the arm, the positioning surfaces positioning the second longitudinal axis at a particular orientation to the first longitudinal axis such that the particular orientation is the same for each said wear member along the front edge of the arm, and means for securing the wear member to the arm in the particular orientation determined by contact of the positioning surfaces and the locator formations, and a rearward facing abutting surface extending generally transverse to a central axis of the wear member to abut a corresponding bearing face supported by the arm, the abutting surface being concave and curved generally about two generally perpendicular axes so as to define generally a bowl-like surface with which to engage the convex bearing face of the base.

55. A wear member in accordance with claim 54 wherein the locator formation includes spaced apart, generally forward facing locating surfaces on the front edge of the arm, and wherein the positioning surfaces of the mounting structure are spaced apart and shaped to matingly contact locator surfaces on the arm.

56. A wear member in accordance with claim 55 wherein the wear member includes sidewalls, each having rearward facing concave edges that generally wrap at least partially around the front edge of the arm, the concave edges including the positioning surfaces.

57. A wear member in accordance with claim 56 wherein the means for securing the wear member comprises a weld fixing the wear member to the arm.

58. A wear member in accordance with claim 54 wherein each said locator formation includes a nose that is fixed to the front edge of the arm in a unique orientation such that the longitudinal axis of the nose defines the first longitudinal axis, and wherein the mounting structure includes a recess to matingly receive the nose, the recess including the positioning surfaces to contact the nose.

59. A wear member in accordance with claim 58 wherein the nose includes a top flat, a bottom flat and two side flats, and wherein The recess includes an upper positioning surface in mating contact with the top flat, a bottom positioning surface in mating contact with the bottom flat and two side positioning surfaces in muting contact with the side flats.

60. A wear member in accordance with claim 54 wherein the means for securing the wear member comprises a weld fixing the wear member to the arm.

61. A wear member for attachment to an excavator on which is fixed a base having a front end, the wear member comprising a rear mounting portion and a front working portion, the mar mounting portion including an abutting surface for abutting the front end of the base, the abutting surface having a shape that conforms to a surface of a sphere.

62. A wear member in accordance with claim 61 further including an opening for receiving a lock to the hold the wear member to the base.

63. A wear member in accordance with claim 62 further including a leg extending rearward over the excavator.

64. A wear member in accordance with claim 63 wherein the leg includes a slot for receiving a portion of the base.

65. A wear member in accordance with claim 64 wherein the abutting surface forms the front end wall of the slot.

66. A wear member in accordance with claim 61 wherein the front working portion is a nose for mounting a point.

67. A wear member for attachment to an excavator on which is fixed a base having a front end, the wear member comprising a rear mounting portion including a recess for receiving the front end of the base, a front working portion, and a rearward facing abutting surface at the front end of the recess to abut the front end of the base, the abutting surface being a concave surface that is generally continuously curved about perpendicular axes.

68. A wear member in accordance with claim 67 further including a rearwardly extending leg, the leg including a slot to receive a portion of the base, and an opening extending through the leg in communication with the slot for receiving a lock, the opening including a forwardly facing rear wall for abutting against the lock to hold the wear member to the base.

69. A wear member in accordance with claim 68 wherein the front working portion is a nose for supporting a point.

70. A wear member in accordance with claim 67 further including an opening into which is received a lock for securing the wear member to the excavator.

71. A wear member in accordance with claim 67 wherein the mounting portion includes a rearward extending leg provided with a slot for receiving the base.

72. A wear member for attachment to an excavator on which is fixed a base having a front end, the wear member comprising a front working portion and a rear mounting portion, the rear mounting portion including a rearwardly opening recess for receiving the front end of the base, the recess being defined by top and bottom walls, sidewalls, and a front end wall to abut the front end of the base, the front end wall having a generally curved, concave shape with a first curvature extending across the recess from one sidewall to the other, and a second curvature extending across the recess from the top wall to the bottom wall.

73. A wear member in accordance with claim 72 wherein the mounting portion further includes a leg that extends over the excavator.

74. A wear member in accordance with claim 73 wherein the leg includes a longitudinal slot for receiving a portion of the base.

75. A wear member in accordance with claim 74 further comprising an opening for receiving a lock to hold the wear member to the base, the opening being in communication with the slot.

76. A wear member in accordance with claim 72 wherein the first and second curvatures are defined generally by the same radius of curvature.

77. A wear member in accordance with claim 72 further comprising an opening for receiving a lock to hold the wear member to the base.

78. A wear member in accordance with claim 72 wherein the sidewalls are generally flat.

79. A wear member for attachment to an excavator on which is fixed a base having a front end, the wear member comprising a rear mounting portion for securing the wear member to the excavator, a front working portion, and a rearward facing abutting surface adapted to abut the front end of the base, the abutting surface having a central portion and marginal portions surrounding the central portion, and the abutting surface being concave and gradually curved such that the marginal portions curve rearward from the central portion in a generally uniform manner about perpendicular axes.

80. A wear member in accordance with claim 79 wherein the abutting surface is a continuously curved surface.

81. A wear member in accordance with claim 79 further including an opening into which is received a lock for securing the wear member to the excavator.

82. A wear member in accordance with claim 79 wherein the mounting portion includes a rearward extending leg provided with a slot for receiving the base.

* * * * *

UNITED STATES PATENT AND TRADEMARK OFFICE

CERTIFICATE OF CORRECTION

PATENT NO. : 7,165,347 B2
APPLICATION NO. : 10/290472
DATED : January 23, 2007
INVENTOR(S) : Charles G. Ollinger, IV et al.

It is certified that error appears in the above-identified patent and that said Letters Patent is hereby corrected as shown below:

In Column 11, line 64, “wrape” should be changed to --wraps--.

In Column 12, line 66, “pert” should be changed to --part--.

In Column 13, line 3, “property” should be changed to --properly--.

In Column 14, line 49, “sidewalks” should be changed to --sidewalls--.

In Column 15, line 64, “The” should be changed to --the--; line 67, “muting” should be changed to --mating--.

In Column 16, line 7, “mar” should be changed to --rear--.

Signed and Sealed this

Eleventh Day of November, 2008

JON W. DUDAS
*Director of the United States Patent and Trademark Office*